US008627905B2

(12) United States Patent
Eyre et al.

(10) Patent No.: US 8,627,905 B2
(45) Date of Patent: Jan. 14, 2014

(54) NON-PLANAR INTERFACE CONSTRUCTION

(75) Inventors: Ronald K. Eyre, Orem, UT (US); Georgiy Voronin, Orem, UT (US)

(73) Assignee: Smith International, Inc., Houston, TX (US)

( * ) Notice: Subject to any disclaimer, the term of this patent is extended or adjusted under 35 U.S.C. 154(b) by 319 days.

(21) Appl. No.: 12/857,983

(22) Filed: Aug. 17, 2010

(65) Prior Publication Data

US 2011/0036642 A1 Feb. 17, 2011

Related U.S. Application Data

(60) Provisional application No. 61/234,535, filed on Aug. 17, 2009.

(51) Int. Cl.
*E21B 10/36* (2006.01)

(52) U.S. Cl.
USPC ..... 175/432; 175/428; 175/420.2; 175/430

(58) Field of Classification Search
USPC ..... 175/432, 428, 434, 420, 420.1, 420.2, 175/430
See application file for complete search history.

(56) References Cited

U.S. PATENT DOCUMENTS

| | | | | |
|---|---|---|---|---|
| 5,709,279 | A * | 1/1998 | Dennis | 175/430 |
| 6,488,106 | B1 | 12/2002 | Dourfaye | |
| 6,962,218 | B2 | 11/2005 | Eyre | |
| 7,243,745 | B2 | 7/2007 | Skeem et al. | |
| 2006/0021802 | A1 | 2/2006 | Skeem et al. | |
| 2008/0302578 | A1 | 12/2008 | Eyre et al. | |
| 2009/0133938 | A1 * | 5/2009 | Hall et al. | 175/434 |

OTHER PUBLICATIONS

International Search Report and Written Opinion dated Mar. 29, 2011 for corresponding PCT application No. PCT/US2010/045726 filed Aug. 17, 2010.

* cited by examiner

*Primary Examiner* — Jennifer H Gay
*Assistant Examiner* — Taras P Bemko

(57) ABSTRACT

A cutting element is provided, including a substrate and an ultra-hard material layer formed over the substrate. At one end of the substrate is an interface surface that interfaces with the ultra-hard material layer to bond the layer to the substrate. The interface surface includes a first or outer annular section that extends to the peripheral edge of the substrate, and a second or inner section that is radially inside the first section. The interface surface includes several spaced-apart projections arranged in an annular row. In one aspect, each projection has an upper surface that defines a groove bisecting the projection. In another aspect, the interface surface may include a bridge coupling adjacent projections.

63 Claims, 13 Drawing Sheets

NON-PLANAR INTERFACE CONSTRUCTION

CROSS-REFERENCE TO RELATED APPLICATIONS

This application claims priority to U.S. Provisional Application No. 61/234,535, filed on Aug. 17, 2009, which is hereby incorporated by reference in its entirety.

BACKGROUND OF THE INVENTION

Cutting elements, as for example cutting elements used in rock bits or other cutting tools, typically have a body (i.e., a substrate), which has an interface end or surface. An ultra hard material layer is bonded to the interface surface of the substrate by a sintering process to form a cutting layer, i.e., the layer of the cutting element that is used for cutting. The substrate is generally made from a tungsten carbide-cobalt alloy (sometimes referred to simply as "cemented tungsten carbide," "tungsten carbide" "or carbide"). The ultra hard material layer is a polycrystalline ultra hard material, such as polycrystalline diamond ("PCD"), polycrystalline cubic boron nitride ("PCBN") or a thermally stable product ("TSP") material such as thermally stable polycrystalline diamond.

Cemented tungsten carbide is formed by carbide particles being dispensed in a cobalt matrix, i.e., tungsten carbide particles are cemented together with cobalt. To form the substrate, tungsten carbide particles and cobalt are mixed together and then heated to solidify. To form a cutting element having an ultra hard material layer such as a PCD or PCBN ultra hard material layer, diamond or cubic boron nitride ("CBN") crystals are placed adjacent the cemented tungsten carbide body in a refractory metal enclosure (e.g., a niobium enclosure) and subjected to high temperature and high pressure so that inter-crystalline bonding between the diamond or CBN crystals occurs, forming a polycrystalline ultra hard diamond or CBN layer. Cobalt from the tungsten carbide substrate infiltrates the diamond or CBN crystals and acts as a catalyst in forming the PCD or PCBN. A catalyst material may also be added to the diamond or CBN particles to assist in inter-crystalline bonding. The process of high temperature heating under high pressure is known as high temperature high pressure sintering process ("HTHP" sintering process). Metals such as cobalt, iron, nickel, manganese and alike and alloys of these metals have been used as a catalyst matrix material for the diamond or CBN.

In some instances, the substrate may be fully cured. In other instances, the substrate may be not fully cured, i.e., it may be green. In such case, the substrate may fully cure during the HTHP sintering process. In other embodiments, the substrate may be in powder form and may solidify during the sintering process used to sinter the ultra hard material layer.

TSP is typically formed by "leaching" the catalyst (such as the cobalt) from the polycrystalline diamond. This type of TSP material is sometimes referred to as a "thermally enhanced" material. When formed, polycrystalline diamond comprises individual diamond crystals that are interconnected defining a network structure. A cobalt binder phase (i.e., the catalyst) is found within interstitial spaces in the diamond network, between the bonded diamond crystals. Cobalt has a significantly different coefficient of thermal expansion as compared to diamond, and as such, upon heating and/or cooling of the polycrystalline diamond during use, the cobalt expands, causing cracks to form in the diamond network, resulting in the deterioration of the polycrystalline diamond layer. In addition, during use, the catalyzing effect of the cobalt can cause graphitization in the interstices of the diamond network, which deteriorates the diamond. By removing, i.e., by leaching, the cobalt from the diamond network structure, the polycrystalline diamond layer becomes more heat resistant. In another exemplary embodiment, TSP material is formed by forming polycrystalline diamond with a thermally compatible silicon carbide binder instead of cobalt. "TSP" as used herein refers to either of the aforementioned types of TSP materials.

To reduce the residual stresses created at the interface between the substrate and the ultra-hard layer, prior art interface surfaces on substrates have been formed having a plurality of projecting spaced apart concentric annular rings, such as annular ring 5 shown in FIG. 1A. Due to the difference in the coefficients of thermal expansion of the substrate and the ultra hard material layer, these layers contract at different rates when the cutting element is cooled after HTHP sintering. Tensile stress regions 2 are formed on the upper surfaces of the rings 3, whereas compressive stress regions 4 are formed on the valleys between such rings, as shown in FIG. 1B, which shows a cross-sectional view of a projecting ring. Consequently, when a crack begins to grow it may grow annularly along the entire upper surface of the annular ring where it is exposed to tensile stresses, or may grow along the entire annular valley between the projections where it is exposed to compressive stresses, leading to the early failure of the cutting element. In other prior art cutting element substrate interfaces incorporating spaced apart projections, the projections have relatively flat upper surfaces or non-planar upper surfaces having one or more shallow depressions. Applicants believe that such upper surfaces may allow a crack to grow and gain momentum and thus become critical.

Common problems that plague cutting elements are chipping, spalling, partial fracturing, cracking and/or exfoliation of the ultra hard material layer. Another frequent problem is cracking on the interface between the ultra hard material layer and the substrate and the propagation of the crack across the interface surface. These problems result in the early failure of the ultra hard material layer and thus in a shorter operating life for the cutting element. Accordingly, there is a need for a cutting element having an ultra hard material layer with improved cracking, chipping, fracturing and exfoliating characteristics, and thereby having an enhanced operating life.

SUMMARY OF THE INVENTION

In an embodiment, a cutting element is provided, including a substrate and an ultra-hard material layer formed over the substrate. At one end of the substrate is an interface surface that interfaces with the ultra-hard material layer. The ultra-hard layer is bonded to the substrate at this interface surface. The interface surface includes a first or outer annular section that extends to the peripheral edge of the substrate, and a second or inner section that is radially inside the first section. The interface surface includes several spaced-apart projections arranged in an annular row. In one embodiment, the projections extend from the first section to the second section, spanning across the intersection of these two sections. In another embodiment, a majority of the projections are wholly located within the second section. In yet another embodiment, each of the projections are located wholly within the second section. The annular row is disposed in a circular path around the central longitudinal axis of the substrate. The projection has an upper surface that defines a groove bisecting the projection. The groove extends from one end of the projection to the other. The groove may be curved to follow the circumference of the interface surface, or it may be straight. The groove extends all the way across the projection and thus has open ends at opposite ends of the projection. In another embodiment, the groove extends in a radial direction across the projection. The interface surface may include a bridge coupling adjacent projections. The groove and the bridge interrupt stress fields that form in the substrate and ultra-hard material and reduce the magnitude of the residual stresses. The interface surface may include both the bridge and the groove, or one without the other.

In an exemplary embodiment, a cutting element includes a substrate having a periphery and an interface surface having a radial direction and a circumferential direction, and an ultra hard material layer formed over the substrate and having an interface surface having a radial direction and a circumferential direction. One of the interface surface of the substrate or the interface surface of the ultra hard material layer includes a first annular section comprising an outer band, a second section located radially inwardly of the first annular section, and a plurality of spaced-apart projections arranged in an annular row and located radially inward of the outer band. A groove bisects an upper surface of each projection, and/or a bridge couples adjacent projections.

In another exemplary embodiment, a cutting element includes a substrate having a periphery and an interface surface having a radial direction and a circumferential direction, and an ultra hard material layer formed over the substrate and interfacing with the interface surface. The interface surface includes a first annular section extending to the periphery of the substrate and having a non-planar outer band having repeating hills and valleys (wave-like surface), and a second section located radially inward of the first annular section. A plurality of spaced-apart projections are arranged in an annular row and located radially inwardly of the outer band. Each projection has a groove bisecting the projection, and each projection is tapered such that it narrows radially inwardly. The groove extends in a circumferential direction, and the center of curvature of the groove is the same as the center of curvature of a circumference of the substrate at the radial position of the groove.

In a further embodiment, a bit is provided incorporating any of the aforementioned cutting elements.

DETAILED DESCRIPTION OF THE INVENTION

In order to improve the resistance to cracking, chipping, fracturing, and exfoliating of cutting elements, Applicants have invented cutting elements having an interface between the ultra hard material layer and the substrate, the interface having unique geometries that improve such resistance.

In the exemplary embodiments described herein, the interface surface is described as being formed on the substrate which interfaces with the ultra hard material layer. It should be understood that a negative or reversal of this interface surface is formed on the ultra hard material layer interfacing with the substrate. Additionally, when projections or depressions are described as being formed on the substrate surface, it should be understood that in other exemplary embodiments they could be formed instead on the surface of the ultra-hard material layer that interfaces with the substrate interface surface, with the inverse features formed on the substrate.

The term "substrate" as used herein means any substrate over which the ultra hard material layer is formed. For example, a "substrate" as used herein may be a transition layer formed over another substrate. The terms "upper," "lower," and other similar terms are relative terms used to denote the relative position between two objects, and not the exact position of such objects. Like reference numbers are used to identify like features. Additionally, as used herein, the terms "radial" and "circumferential" and like terms are not meant to limit the feature being described to a perfect circle.

Figure 1A:
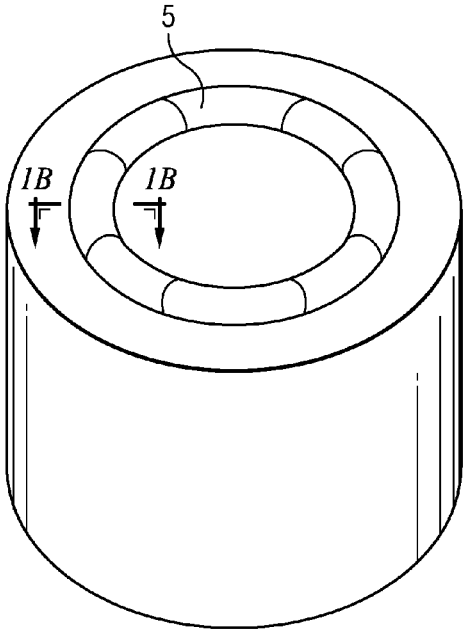
FIG. 1A (PRIOR ART)
FIG. 1A is a perspective view of a prior art cutting element.
Figure 2:
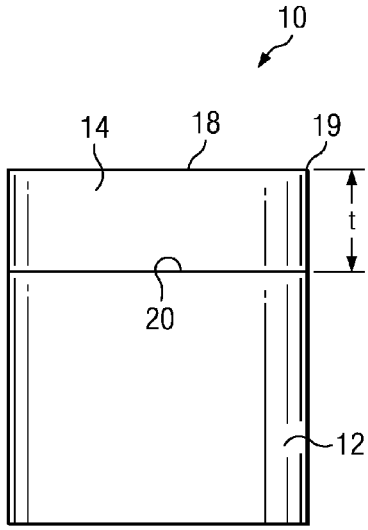
FIG. 2 is an end view of a cutting element according to an exemplary embodiment of the invention.
Figure 3:
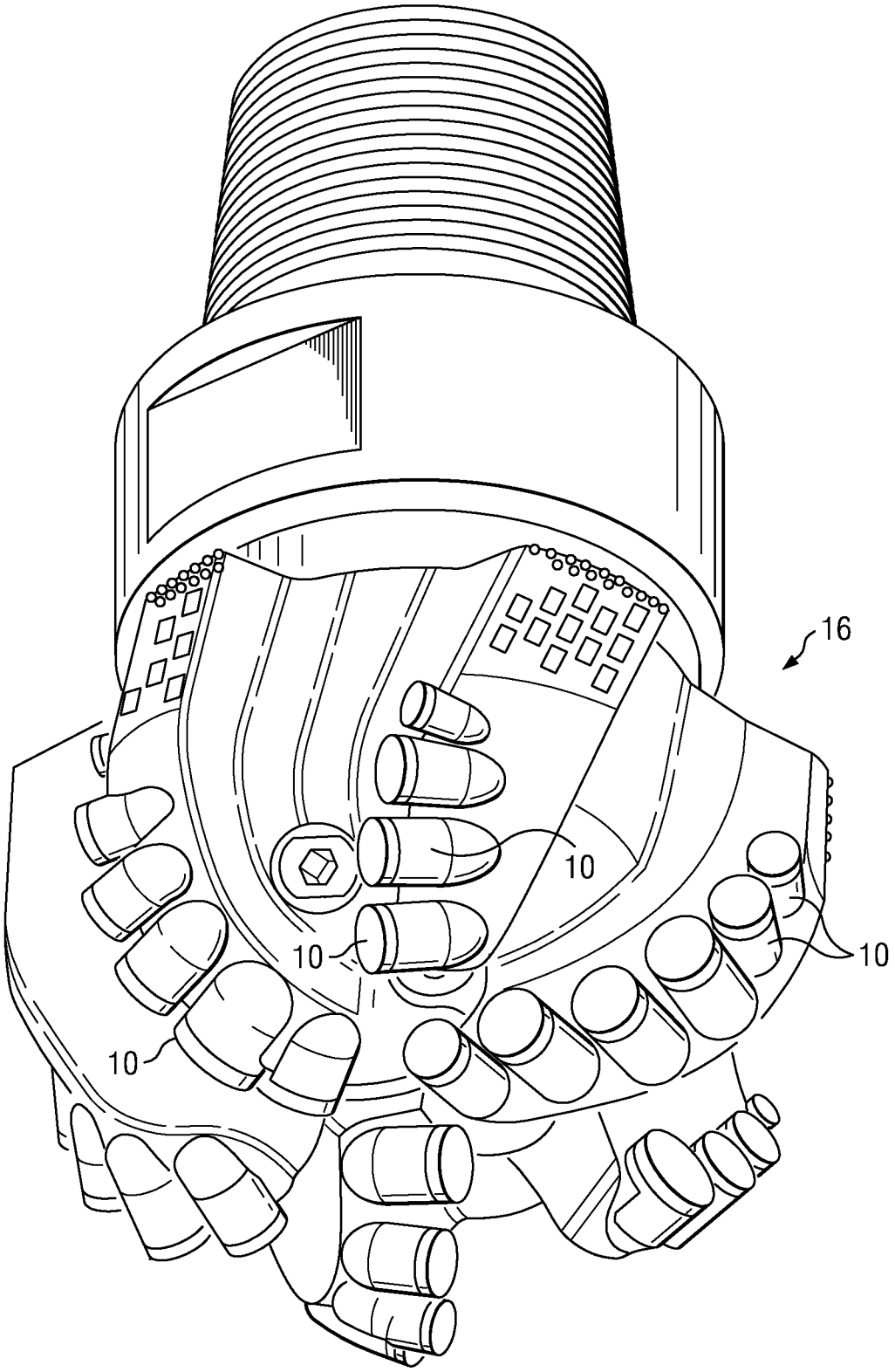
FIG. 3 is a perspective view of a drag bit body incorporating exemplary embodiment cutting elements of the present invention.

In an embodiment as shown in FIG. 2, a cutting element such as a shear cutter 10 includes a substrate 12 with a layer of ultra-hard material 14 having thickness t formed on the substrate 12. The substrate may be formed of a hard material such as cemented tungsten carbide. The ultra-hard material may be polycrystalline diamond (PCD), polycrystalline cubic boron nitride (PCBN), or a thermally stable product such as thermally stable PCD (TSP). The cutting element 10 may be mounted into a bit body such as the drag bit body 16 shown in FIG. 3. The exposed top surface of the ultra-hard material opposite the substrate is the cutting face 18, which is the surface which, along with its edge 19, performs the cutting.

Figure 4:
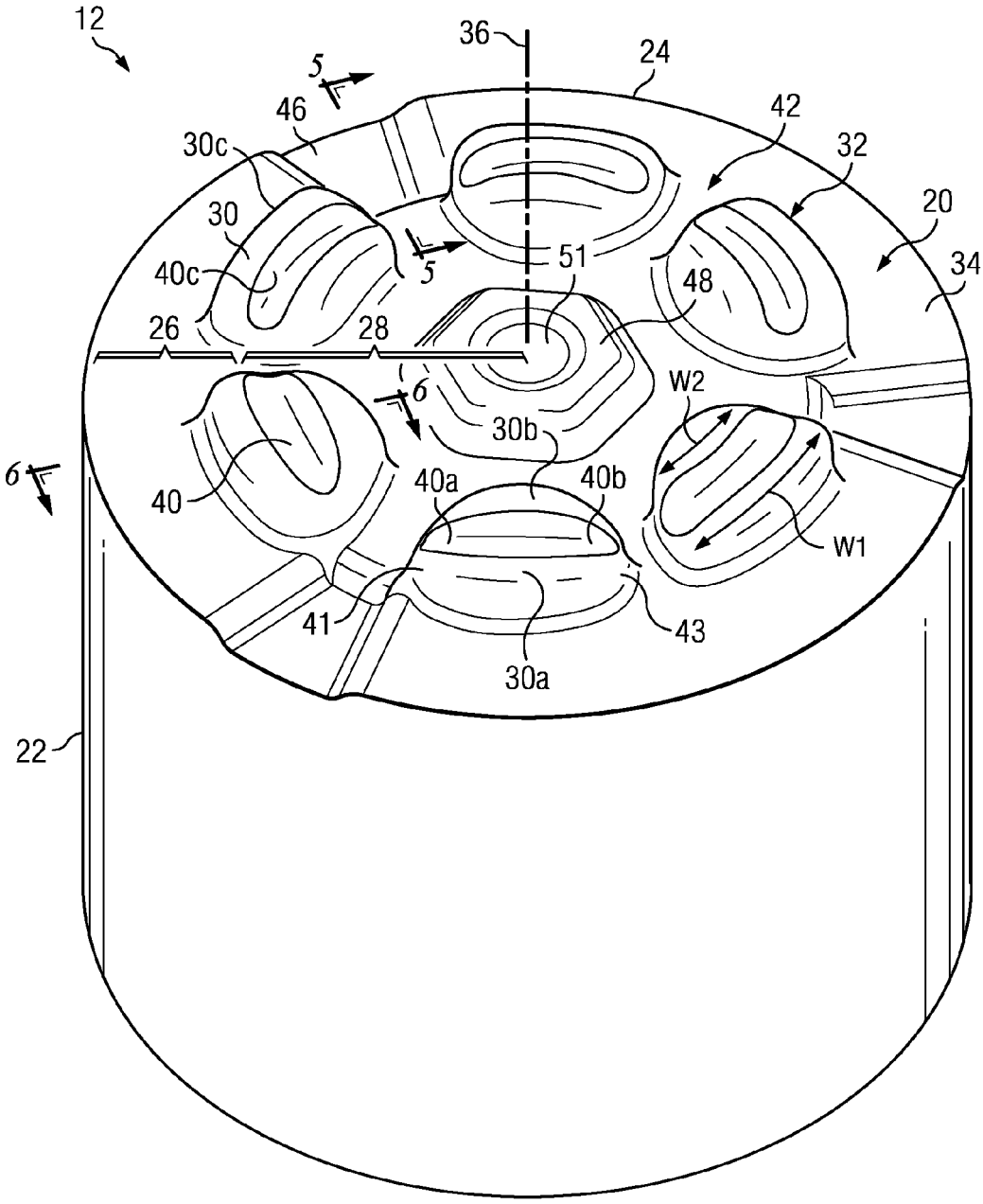
FIG. 4 is a perspective view of a substrate according to an exemplary embodiment of the invention.

A perspective view of the substrate 12 is shown in FIG. 4. At one end of the substrate 12 is an interface surface 20 that interfaces with the ultra-hard material layer 14 (not shown). The substrate 12 is generally cylindrical and has a peripheral surface 22 and a peripheral top edge 24. In the exemplary embodiment shown, the interface surface 20 includes a first or outer annular section 26 that extends to the peripheral edge 24, and a second or inner section 28 that is radially inside the first annular section 26. The first and second sections 26, 28 may be at different levels, forming a step therebetween which may be curved, linear, or non-linear. For example, the first section 26 may be lower or higher than the second section 28. Alternatively, the two sections may be at the same level, as shown in FIG. 4.

The interface surface 20 includes several spaced-apart projections 30 arranged in an annular row 32. The projections 30 straddle the first section 26 and the second section 28, spanning across the intersection of these two sections. The projections 30 are located radially inside an outer band 34, which is at the radially outer portion of the first section 26. That is, the outer band 34 extends from the projections 30 to the peripheral edge 24. In the embodiment shown, the annular row 32 is disposed in a circular path around a central longitudinal axis 36 of the substrate 12. However, the invention is not limited to this geometry, as, for example, the annular row 32 may be elliptical or asymmetrical, or may be offset from the axis 36. The annular row 32 in FIG. 4 locates the projections 30 closer to the outer edge 24 than to the longitudinal central axis 36, but in other embodiments the projections may be closer to the longitudinal central axis.

Figure 5:
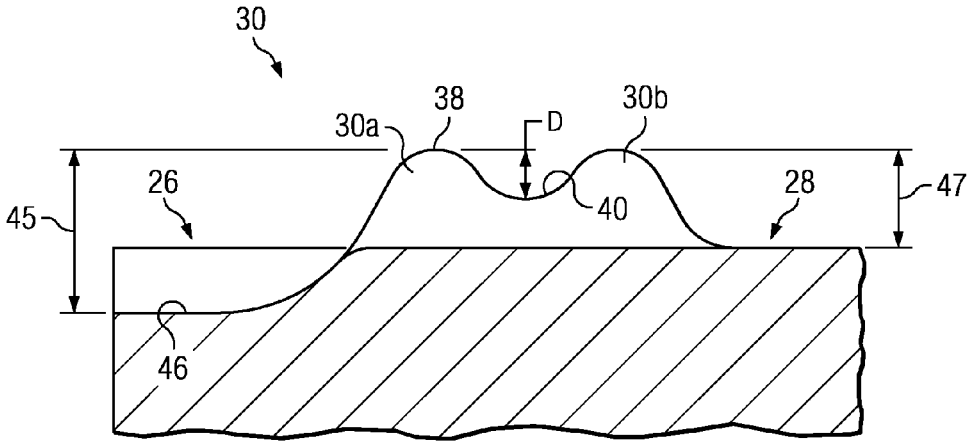
FIG. 5 is an end view of a projection on the substrate of FIG. 4, taken along line 5-5 in FIG. 4.

An end view of one of the projections 30 taken along a diameter plane is shown in FIG. 5, as viewed from the line 5-5 shown in FIG. 4. The projection 30 has a smoothly curving upper surface 38, in cross-section along the diameter plane, that defines a groove 40 in the projection 30. In this embodiment, the groove 40 extends across the length of the projection 30, from one end 41 of the projection to the other end 43 of the projection (FIG. 4), dividing or bisecting the projection to form two smaller projections 30*a*, 30*b*. As used herein, the term "bisects" does not require the groove to cut across the exact center of the projection, or have a depth that extends all the way to the bottom of the projection. Rather, "bisects" indicates that the groove extends across the top surface of the projection, from one end of the projection to the other, forming two smaller projections such as 30*a*, 30*b* on either side of the groove.

The groove 40 may be curved to follow the circumference at its radial position, so that, together, the grooves 40 in each of the spaced-apart projections 30 outline a dashed circle. That is, the groove may have the same center of curvature as the circumference at the radial position of the groove. Alternatively, the groove 40 may have a curvature that is different than the curvature of the circumference at the radial position of the groove 40; that is, the groove 40 may curve more or less than the circumference of the surface 20 where the groove is located or may have a different center of curvature. Alternatively, the groove 40 may be straight, with the center of the groove extending at an angle (such as a 90° angle) to a radius of the substrate. The groove extends all the way across the projection and thus has open ends 40*a*, 40*b* at opposite ends of the projection. The open ends of the groove open into the space 42 between projections 30 (FIG. 4).

Figure 6:
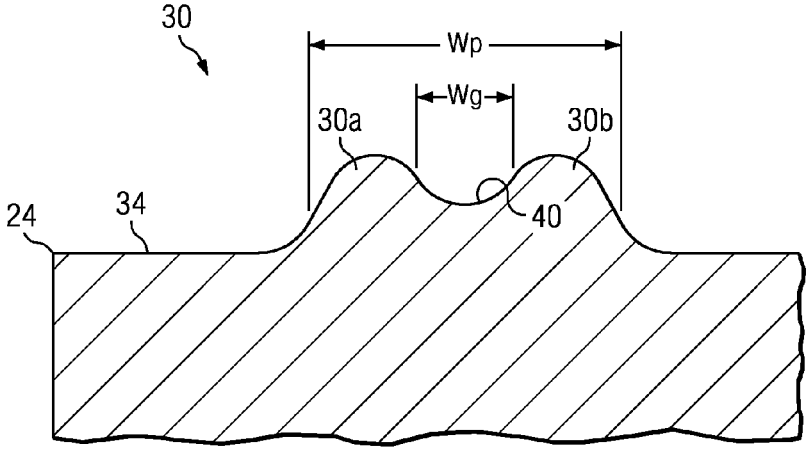
FIG. 6 is a cross-sectional view of a projection on the substrate of FIG. 4, taken along line 6-6 in FIG. 4.

As shown in FIG. 5, the groove 40 has a depth D that is less than the height 45 of the projection 30 as measured from the depression 46 (described below) or the height 47 as measured from the first annular section 26 or the second section 28. That is, the groove 40 does not extend all the way down to either of the sections 26, 28. In an exemplary embodiment, the depth D of the groove ranges from about 50% to about 150% of the width of the groove Wg (FIG. 6). A shallower groove with a smaller depth D creates a smaller compressive stress region above the groove as compared to a deeper groove with a larger depth D. In an exemplary embodiment, the projection 30 has a height 47 (FIG. 5) that is about 30% to about 70% of the thickness t of the ultra-hard layer 14 (see FIG. 2). In another exemplary embodiment, the height 47 of the projection is about 35% to about 45% of the thickness t of the ultra-hard layer. In an embodiment, the thickness t of the ultra-hard layer is 0.100 inches, and the height 47 of the projection is 0.04 inches. In one embodiment, these depths and widths are measured from the applicable points of inflection along the groove or projection.

In an exemplary embodiment, the width of the groove Wg (see FIG. 6) ranges from about 20% to about 50% of the width Wp of the protrusion. If the groove is too wide, with too large a Wg, then the bisected sides 30*a*, 30*b* of the projection (FIG. 6) could be too narrow, and too fragile. A wide groove with narrow projections 30*a*, 30*b* creates a sharp tensile region above these projections 30*a*, 30*b*, and these projections 30*a*, 30*b* could break during manufacturing. On the other hand, if the groove is too narrow, with a small width Wg, then it may not be effective to interrupt the stress field above the projection, as described further below.

Referring again to FIG. 4, in an exemplary embodiment, the projections 30 are slightly trapezoidal or tapered in shape, being wider (width W1) near the first annular section 26 (radially outwardly), and becoming narrower in width (width W2) closer to the second section 28 (radially inwardly). Spaces or valleys 42 separate each projection 30 from the adjacent projections. In FIG. 4, the projections are spaced equally along the annular row 32, with each projection 30 having the same dimension and each space 42 having the same dimension. In exemplary embodiments, the projections are tapered to maintain uniform spacing between them. The projections can be formed in any desired shape and spaced apart from each other in a uniform manner to balance the stress fields over the interface surface.

FIG. 6 shows a cross-sectional view of one of the projections 30, taken along the line 6-6 in FIG. 4. This cross-section is taken through the center of the projection 30, along a plane extending through a diameter of the substrate 12. As shown in FIG. 6, the groove 40 bisects the projection to form two smaller bulges or projections 30*a*, 30*b* on either side of the groove 40. The groove 40 may be positioned near the center of the projection 30 to form two equal-sized projections 30*a*, 30*b* as viewed in cross-section, or it may be offset to form one projection 30*a* that is smaller than the other projection 30*b*. For example, in one embodiment, projection 30*a* is thinner and longer than projection 30*b*, which is shorter and wider. These relative sizes can be reversed, or the projections could be approximately uniform size.

The groove 40 affects the stress distributions in the cutting element 10 and improves the cutting element's resistance to crack growth, in particular, crack growth along the interface surface 20. As discussed above, the substrate 12 and ultra-hard material layer 14 have different coefficients of thermal expansion, which can cause stresses to generate along the interface surface 20 when the cutting element is cooled after HTHP sintering and when the cutting element is in use. Tensile, compressive, shear, and other stresses cause cracks to form and grow within the stress fields in the substrate as well as in the ultra-hard material and on the interface.

Figure 1B:
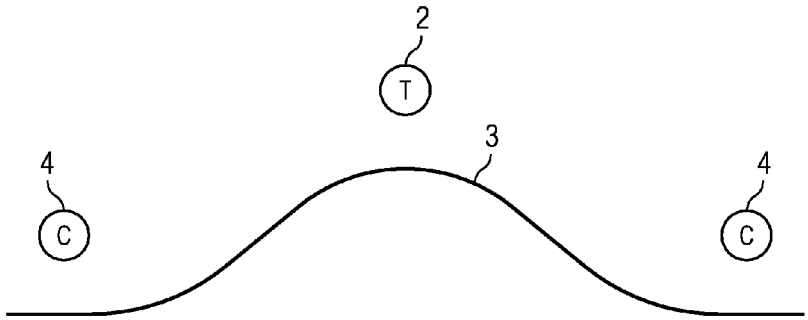
FIG. 1B (PRIOR ART)
FIG. 1B is a cross-sectional diagram of a stress field above an interface surface projection of the prior art cutting element of FIG. 1A, taken along the line 1B.
Figure 7:
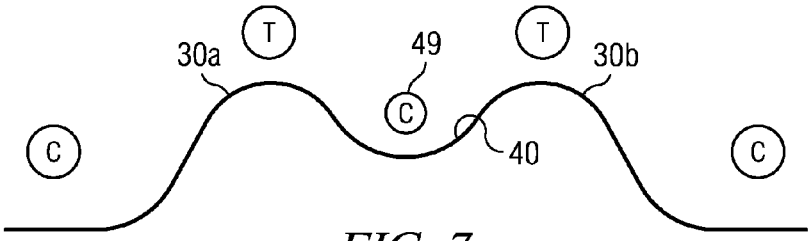
FIG. 7 is a diagram of a stress field above a projection according to an exemplary embodiment of the invention.

As shown in FIG. 1B, a simple annular band or projection on the interface surface creates an area of tensile stress above the projection and areas of residual compressive stress in the valleys or spaces between the projections or bands. As shown in FIG. 7, the groove 40 interrupts the field of tensile strength above the apex or top of the projection 30 and creates a small area 49 of compressive stress. This area of compressive stress interrupts the tensile stress field above the projection and reduces the magnitude of those tensile stresses in such tensile field. The tensile stresses above projections 30*a* and 30*b* do not grow to as large a magnitude with the groove 40 present as they would without the groove, because the compressive stress above the groove interrupts the tensile stress field. As a result, the tensile stresses are divided into two tensile stress fields, each having a lower magnitude than they would have without the groove. Thus, the interface surface with the grooves 40 formed across the projections 30 reduces the residual stresses as compared to an interface surface with annular bands or spaced-apart projections without such grooves. The reduced magnitude of the residual stresses lowers the risk of annular crack growth.

Also, the pocket of compressive stress above the groove 40 arrests crack growth across the tensile stress zones above projections 30*a*, 30*b*. If a crack forms along the interface surface and grows radially under either the tensile or compressive stresses, the crack growth will slow or stop when it reaches an adjacent section with the opposite type of stress. For example, if a crack grows radially along one of the tensile regions above projection 30*a*, crack growth will be arrested when it reaches the area of compressive stress 49 above the groove 40.

The groove 40 with its open ends 40*a*, 40*b*, provides a gradual interruption of the stress field above the projection 30. As the groove 40 opens up into the space 42 between projections 30, at the open ends 40*a*, 40*b* of the groove (FIG. 4), the small compressive stress region 49 above the groove dissipates into a larger compressive stress region in the space 42. The groove with open ends 40*a*, 40*b* differs from a shallow depression or pocket in the projection without open ends, because the open ends 40*a*, 40*b* provide a more gradual dissipation of the stress field, flowing more smoothly into the space 42. The shallow depression or pocket without open ends has a more abrupt transition from compressive stress above such a depression or pocket, to tensile stress at the closed ends or periphery of the depression or pocket, and then back to compressive stress in the space 42. The groove with its open ends provides improved balancing of and transition between the compressive and tensile stresses.

A depression 46 within the space 42 is formed in the outer band 34 radially outside of the projections 30. The depression 46 interrupts the hoop stresses that may form around the annular outer band 34 and thus acts to arrest crack growth circumferentially around this band 34. In FIG. 4, three depressions 46 are provided, spaced between every two projections 30. In other embodiments, more or less than three depressions 46 may be provided, and they may or may not be arranged symmetrically around the band 34.

The interface surface 20 may include a central projection 48 inside the annular row 32, located in the second section 28. The central projection 48 can take many shapes, such as elliptical, circular, or polygonal. In FIG. 4, the central projection 48 is shorter (lower) in height than the surrounding projections 30, but in other embodiments it may be the same height or taller (greater) in height. The central projection 48 acts to interrupt stress fields that form inside the annular row 32. The central projection may also have at least a slight depression 51.

In FIG. 4, the interface surface 20 is shaped as a flat surface with the projections and depressions as described above. However, in other embodiments, these three-dimensional geometries can be formed on a domed, curved, or other shaped surface 20.

Figure 8:
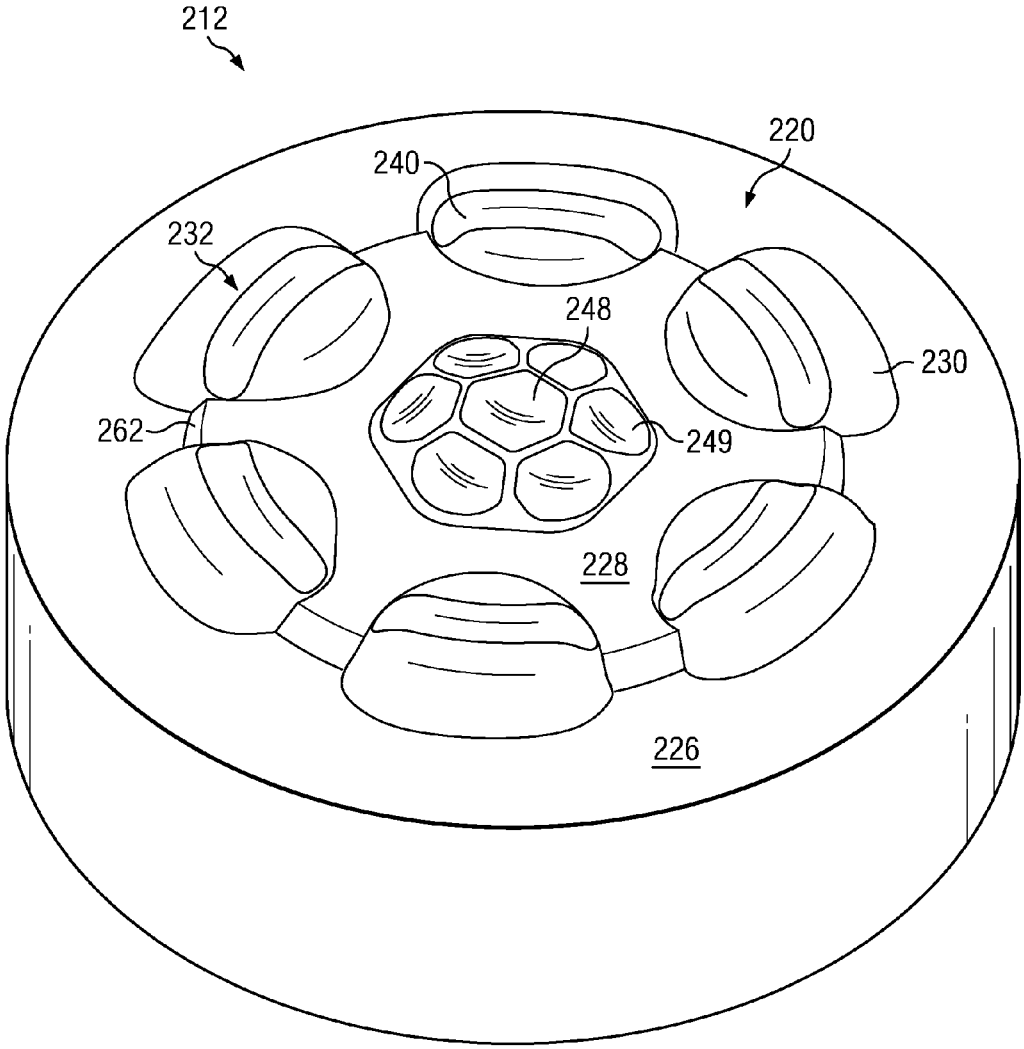
FIG. 8 is a perspective view of a substrate according to an exemplary embodiment of the invention.

Another exemplary embodiment of a substrate and interface surface is shown in FIG. 8. The interface surface 220 of substrate 212 includes an annular row 232 of spaced-apart projections 230, each having a circumferentially-curving groove 240 passing through the projection. In this embodiment, the projections 230 are relatively short or shallow, and the groove 240 extends all the way down to the surface of the inner section 228. The interface surface 220 also includes a step 262 between the inner section 228 and the outer annular section 226, with the inner section 228 at a higher level than the outer annular section 226. The step 262 is positioned generally in the middle of the projections 230 to bisect such projection, with an inner portion of each projection on the inner section 228 and an outer portion of the projection on the outer section 226. The groove 240 extends down to the level of the inner section 228. Additionally, the central projection 248 includes shallow depressions 249 which interrupt the stress field above the central projection.

Figure 9:
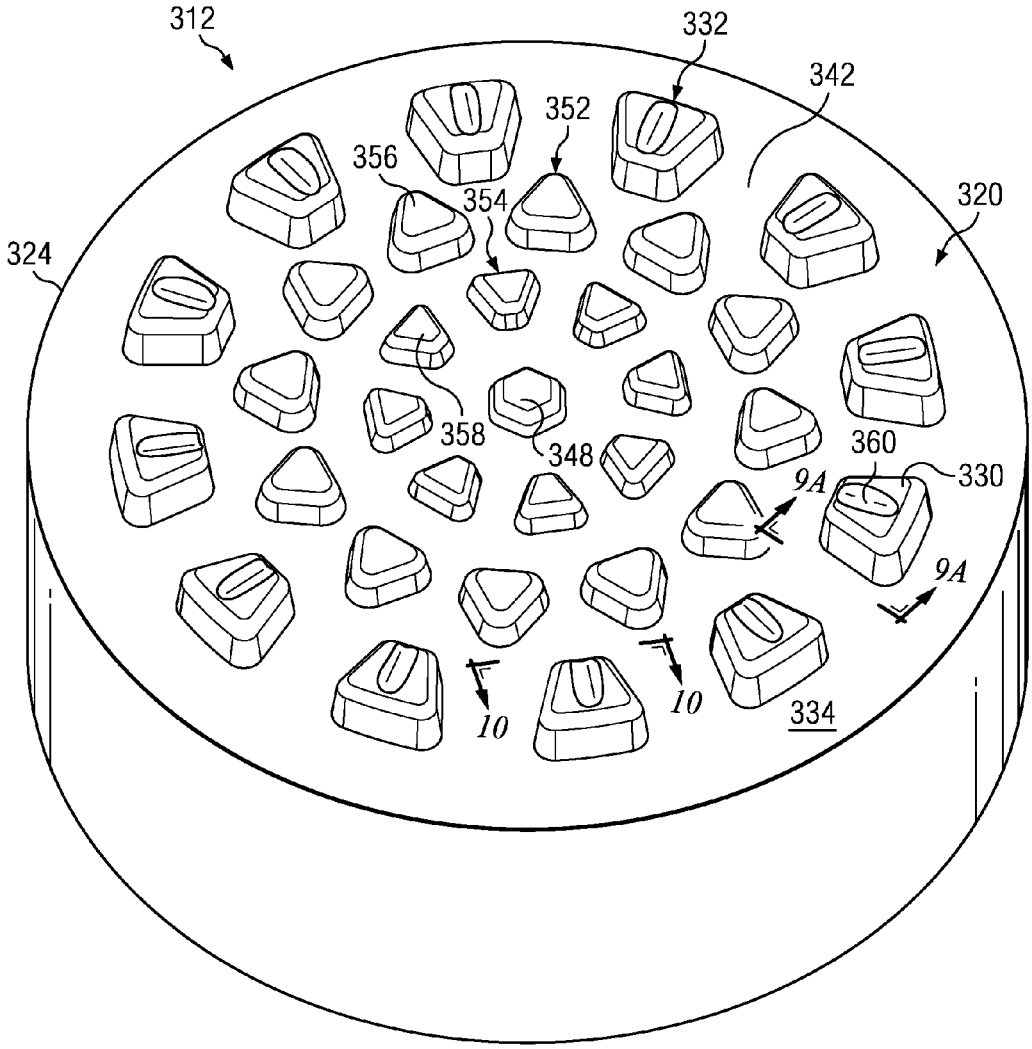
FIG. 9 is a perspective view of a substrate according to an exemplary embodiment of the invention.

Another exemplary embodiment of a substrate and interface surface is shown in FIG. 9. The substrate 312 has an interface surface 320 with three annular rows 332, 352, 354 of spaced-apart projections. The outer-most annular row 332 has several spaced-apart projections 330, with spaces 342 between the projections. The projections 330 forming the first annular row 332 are located inside an outer band 334 that extends to the edge 324 of the substrate. The second or intermediate annular row 352 includes spaced-apart projections 356, and the third or inner annular row 354 includes spaced-apart projections 358. A central projection 348 is located radially inside the third annular row 354.

In this embodiment, each projection 330 of the outer-most or first annular row 332 has a curving top surface 338 that forms a groove 360 in the top of the projection. The groove 360 is straight and extends in a radial direction. As shown in the side view of FIG. 10, the groove 360 has a depth that is less than the height of the projection 330.

Figure 9A:
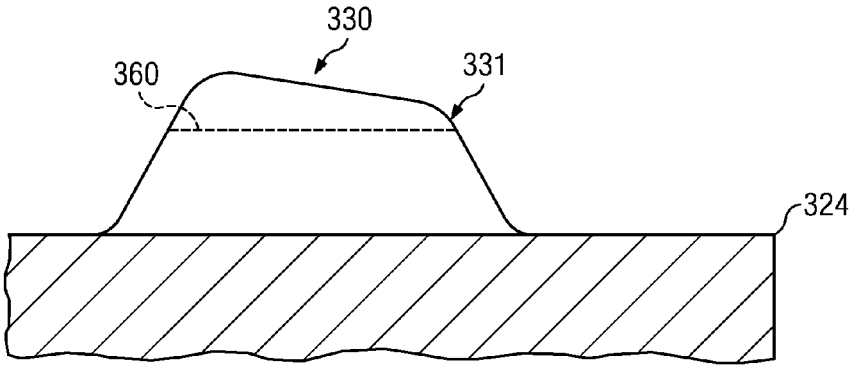
FIG. 9A is an end view of a projection on the substrate of FIG. 9, taken along the line 9A-9A in FIG. 9.

In one embodiment, the projections 330 in the radial outermost row have a sloping top surface, as shown in FIG. 9A. The top surface slopes down toward the peripheral edge 324. The groove 360 is formed through the projection 330 without sloping, so that the depth of the groove decreases as the top surface of the projection 330 slopes down. The groove is deeper (greater depth) at the radially inward end of each projection, and the groove becomes shallower (lesser depth) toward the radially outward end. In one embodiment, the groove essentially disappears at the radially outward end 331 of the projection, where the sloping top surface meets the groove. In other embodiments, the groove may still have some depth at this end 331, or the groove may be cut at an angle to follow the sloping top surface. Additionally, in other embodiments the projection 330 could slope in the other direction, with the top surface sloping up toward the end 331 rather than sloping down toward this end.

Figure 10:
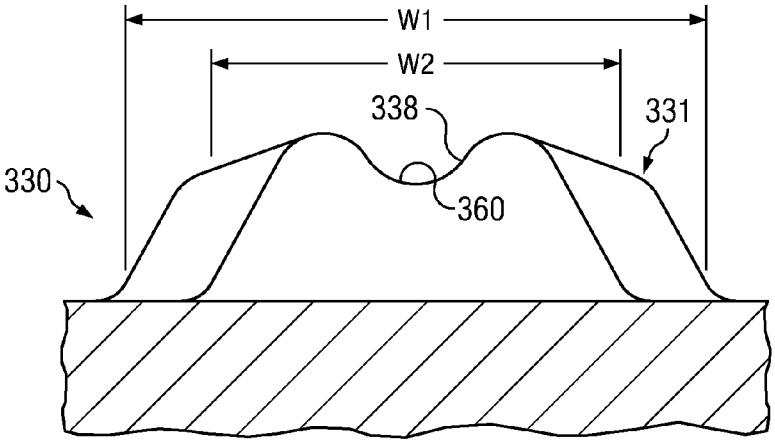
FIG. 10 is a side view of a projection on the substrate of FIG. 9, taken along the line 10-10 in FIG. 9.

The projections 330 of the first annular row in FIGS. 9-10 are trapezoidal in shape, with the width W1 at the radial outward side of the projection being larger (greater) than the width W2 at the radial inward side of the projection. This tapered shape provides a uniform spacing of the projections 330 throughout the interface surface 320, in order to balance the compressive and tensile stresses.

The projections 356 in the second or intermediate row 352 are positioned to radially align with the spaces 342 between the first projections 330 in the first row 332. Each projection 356 is equidistant from the two adjacent projections 330 in the first row. The second row 352 includes the same number of projections as the first row 332. In the shown exemplary embodiment, the projections 356 in the second row 352 are smaller than the projections 330 in the first row and are inverted or reversed; that is, they are tapered in the reverse direction as the first projections 330, tapering radially outwardly to a more narrow (lesser) width than the radially inward width. As such, the second projections 356 project toward the spaces 342 between the tapered first projections 330 to provide an even distribution of spaces and projections. In an exemplary embodiment, the projections 356 are generally flat on top, without sloping as the projections 330 in the outer row slope. In the shown exemplary embodiment, the projections 352 are triangular in plan view. The projections and spaces are staggered, with projections in one row overlapping spaces in the next row, and vice versa. This staggered or mis-aligned distribution of three-dimensional features at the interface helps to distribute the compressive and tensile stresses and reduce the magnitude of the stress fields and arrest crack growth by preventing an uninterrupted path for crack growth.

The projections 358 in the third or inner annular row 354 are tapered in the reverse direction as the second projections 356. The third projections 358 narrow (decrease in width) radially inwardly. In this embodiment, the third row 354 contains fewer projections than does the second row 352. However, in other embodiments, the size of these third projections 358 may be reduced further in order to provide the same number of projections in this row, with each projection aligned with the spaces between the projections in the second row. The size (including length, width, and height) of the projections in an inner row may be at most 60% of the size of the projections in the adjacent outer row.

In an exemplary embodiment, the height of the projections in each subsequent row decreases moving radially inwardly. That is, the maximum height of the radially-outermost first projections 330 is greater than the height of the second projections 356, which is greater than the height of the radially-innermost third projections 358. The central projection 348 inside the third row 354 has a height that is less than the height of the third projections 358. This arrangement can be used on a domed interface surface, where the surface 320, without any projections on it, has a domed shape. The projections vary in height as just described so that the top of the projections in the various rows are in approximately the same plane. The central projection 348 is the shortest, as it is at the top of the dome. The projections 330 at the outermost row are the tallest, although they may be sloped down toward their outer end 331, as described above. The domed interface surface further reduces the residual stresses between the diamond and substrate layers.

Figure 11:
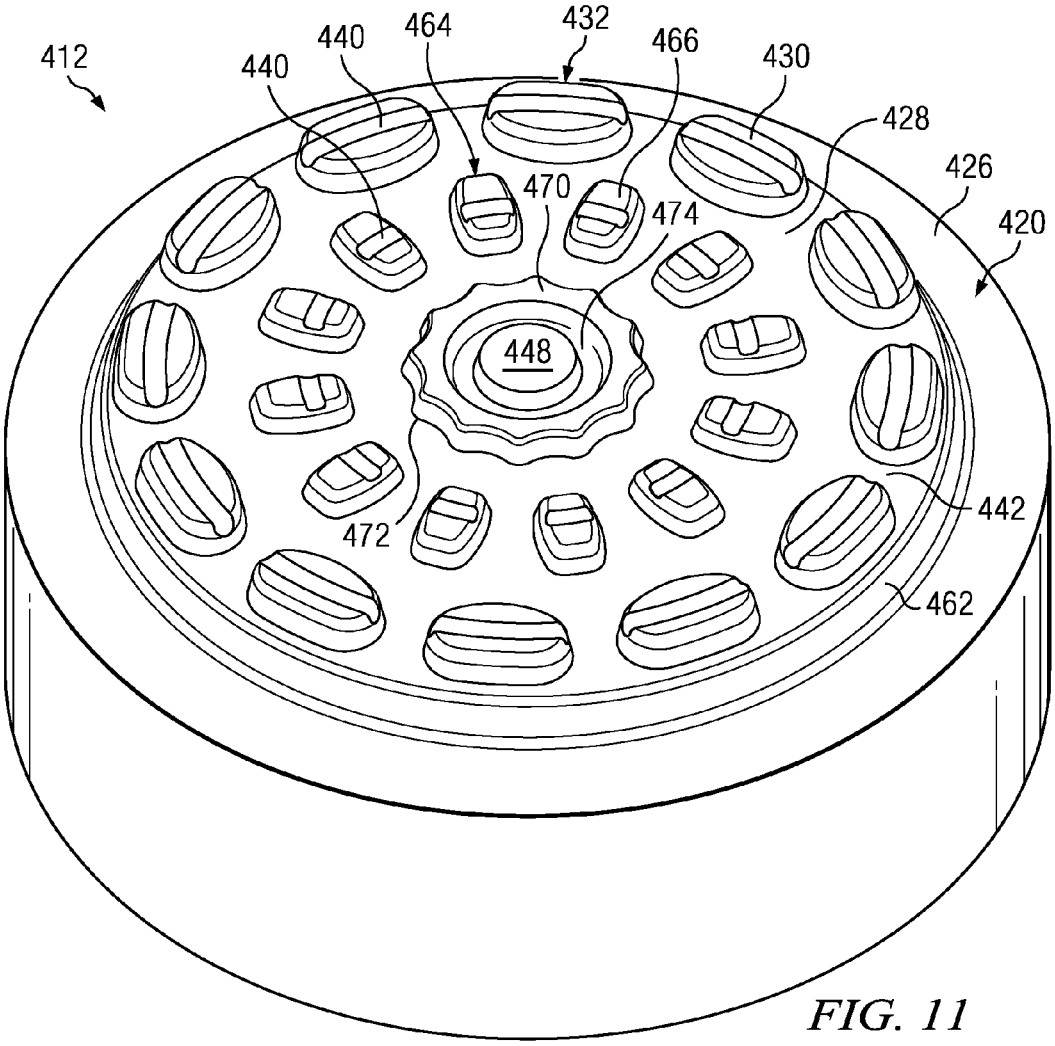
FIG. 11 is a perspective view of a substrate according to an exemplary embodiment of the invention.

Another exemplary embodiment of a substrate and interface surface is shown in FIG. 11. In this embodiment, the interface surface 420 of the substrate 412 includes a first annular section 426 at a lower level than the radially-inward second section 428. A curved step 462 connects the two sections.

Two annular rows of spaced-apart projections are located within the inner section 428. The first or outer row 432 includes projections 430 having grooves 440, and the second inner row 464 includes projections 466 having grooves 440. Projections 430 and 466 include circumferentially extending grooves 440 extending from one end of the projection to the other.

The projections 466 in the second row 464 have inverted or reversed radial and circumferential dimensions compared to the projections 430 in the first row 432. That is, the first projections 430 have a length in the circumferential direction that is longer (greater) than their length in the radial direction, and the second projections 466 have a length in the circumferential direction that is shorter (lesser) than their radial length. The projections in the second row do not necessarily have the same proportions as those in the first row. As in FIG. 9, the projections 466 in the second row are aligned with the spaces 442 between projections 430 in the first row, and each row has the same number of projections. This arrangement of the projections in the two rows facilitates the spacing of the adjacent rows of projections, such that the projections can be spaced apart and staggered, to thereby distribute and interrupt the stress fields above and around the projections.

In this embodiment, the interface surface 420 includes an annular band 470 radially inside the second row 464 of projections 466. This annular band 470 has a wavy outer edge 472. The wavy edge 472 interrupts stress fields in that region by creating small, alternating compressive and tensile stress regions. A central projection 448 is located radially inside the annular band 470, and is divided from the annular band by an annular groove 474. This central projection creates an area of tensile stress above the projection, interrupting the stress fields at the center of the interface surface, inside the annular rows of projections. FIG. 11 also shows an example of an interface surface in which the projections are all positioned inside the step 462.

Figure 12:
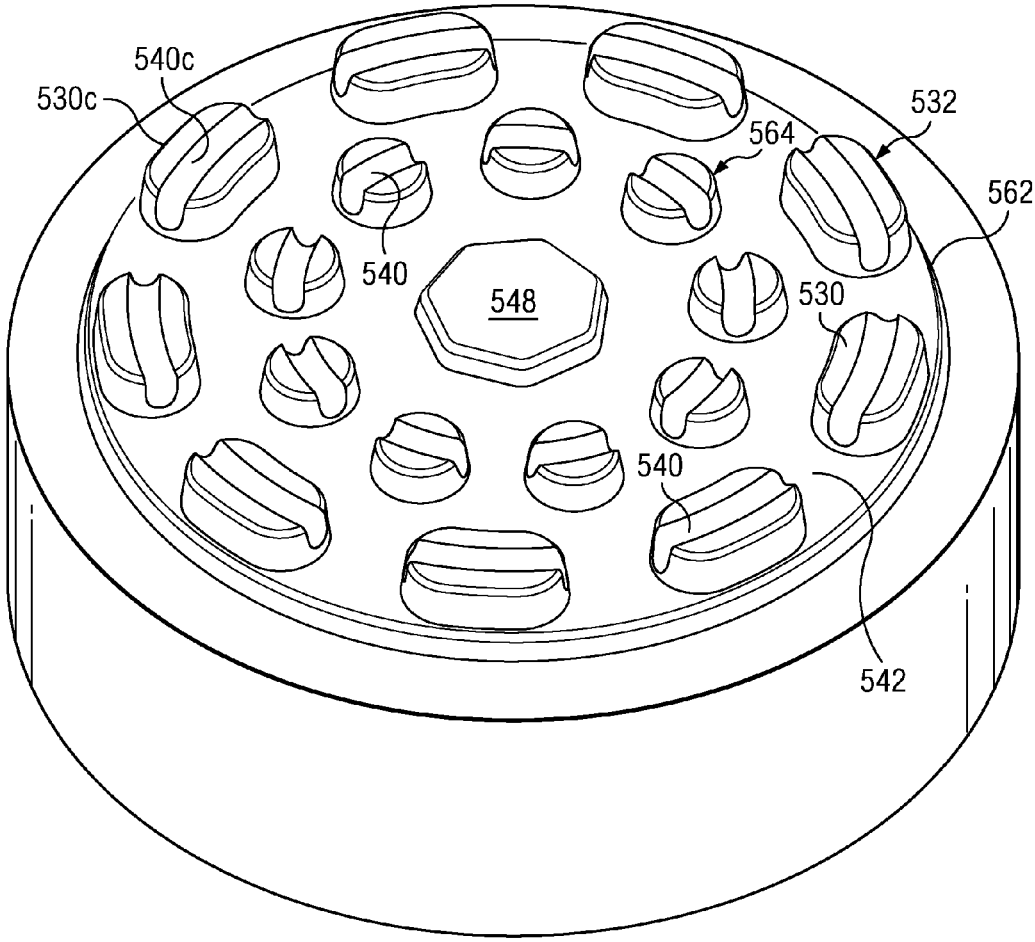
FIG. 12 is a perspective view of a substrate according to an exemplary embodiment of the invention.
Figure 13:
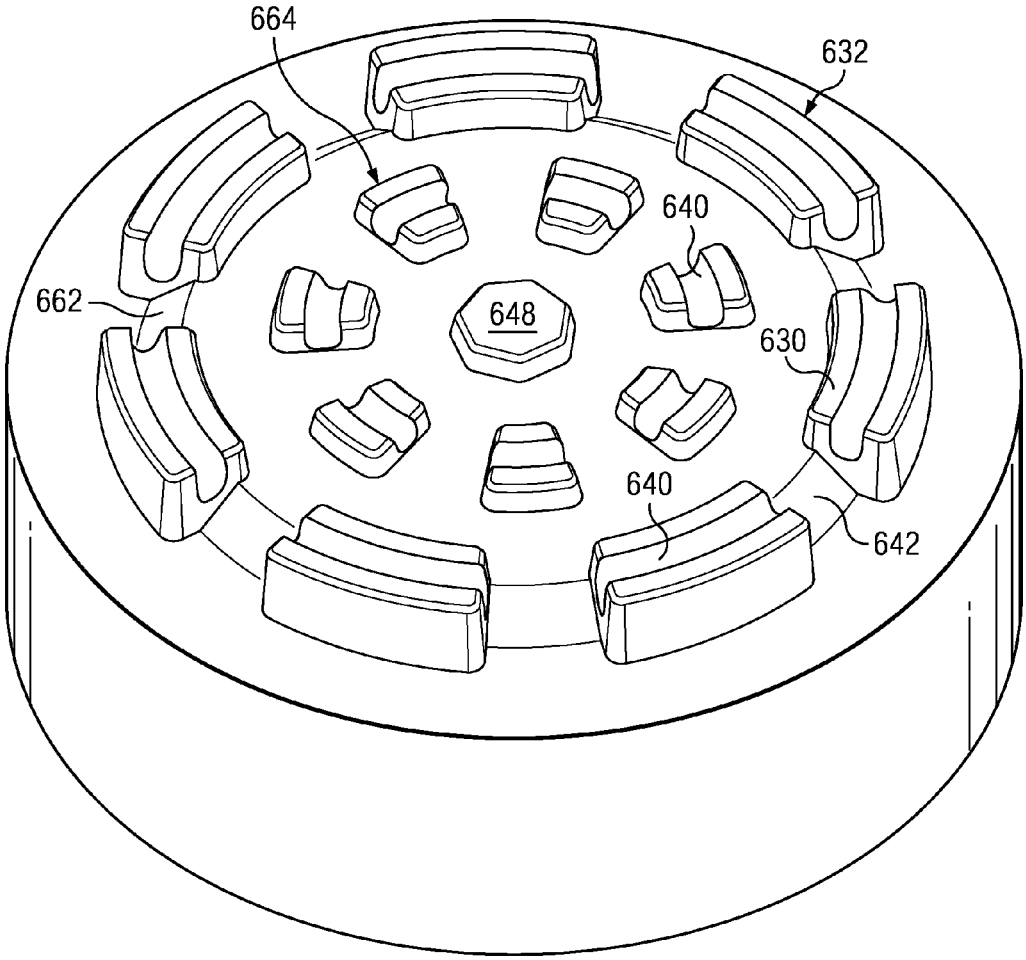
FIG. 13 is a perspective view of a substrate according to an exemplary embodiment of the invention.
Figure 14:
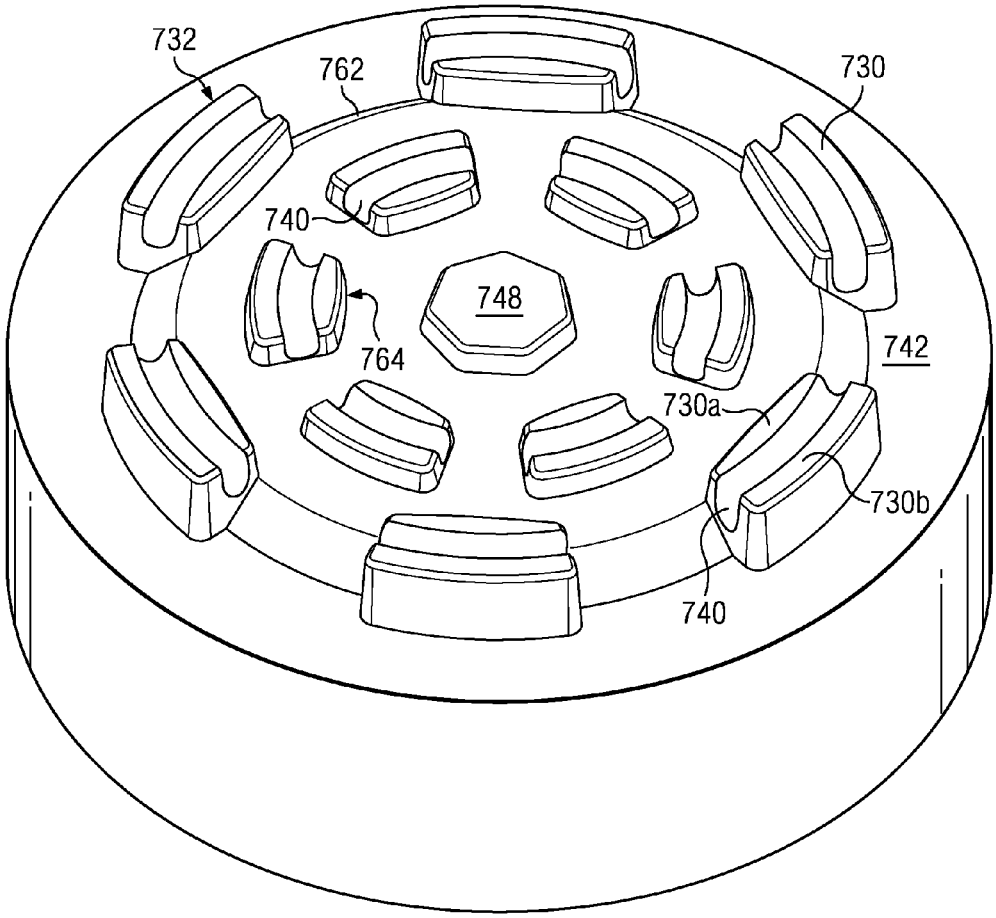
FIG. 14 is a perspective view of a substrate according to an exemplary embodiment of the invention.

The number and arrangement of projections in each row can vary, as shown in FIGS. 12-14. In the embodiment shown in FIG. 12, each row of projections includes nine projections. In the embodiment shown in FIG. 13, each row includes seven projections, and in FIG. 14, six projections. The projections in the outer rows of FIGS. 13 and 14 are longer in the circumferential direction than those shown in FIG. 12. The projections in the inner row of FIG. 14 are longer circumferentially than those in FIG. 13. Also, in FIG. 14, the spaces between projections are longer circumferentially than the spaces in FIG. 13. In each figure, the projections in the inner row are aligned with the spaces between the projections in the outer row. These figures also show the potential variation in the central projection, which is larger in FIG. 12 than in FIG. 13.

FIGS. 12-14 also show the potential variation in the shape of the projections. For example, the projections 30 in FIG. 4 have a more gradual and tapered curving top surface 38 than do the projections 530 in FIG. 12, which rise up from the surrounding surface more sharply and steeply, although the corners of the projections 530 may be rounded. The projections 530 have a generally flat top surface, while the projections 30 in FIG. 4 have a rounded or domed top. Additionally, the groove 540 in FIG. 12 has a more steep and sharp outline than the groove 40 in FIG. 4. The projections 530 are also more rectangular and more symmetrical than the projections 30 in FIG. 4, which are comparatively more trapezoidal. Additionally, the grooves 540, 640, 740 in FIGS. 12-14 are deeper than the groove 40 in FIG. 4. Moreover, the edges 30*c*, 40*c* of the projections 30 and grooves 40 in FIG. 4 are more rounded than those in FIGS. 12-14.

FIG. 12 shows a shallow step 562 radially outside of the projections, and projections 530 that have approximately the same size on each side of the groove 540. FIG. 13 shows a step 662 that is located in the middle of the projections 630 to bisect each projection, generally aligned with the grooves 640. The projections 630 are approximately the same size on each side of the groove 640. In FIG. 14, the inner portion 730*a* of the projection 730 is wider toward its middle, and thinner toward its ends, while the outer portion 730*b* has a generally constant thickness. Each of these geometries is an example of an interface surface arranged to balance the compressive and tensile stresses around the projections on the surface.

Figure 15:
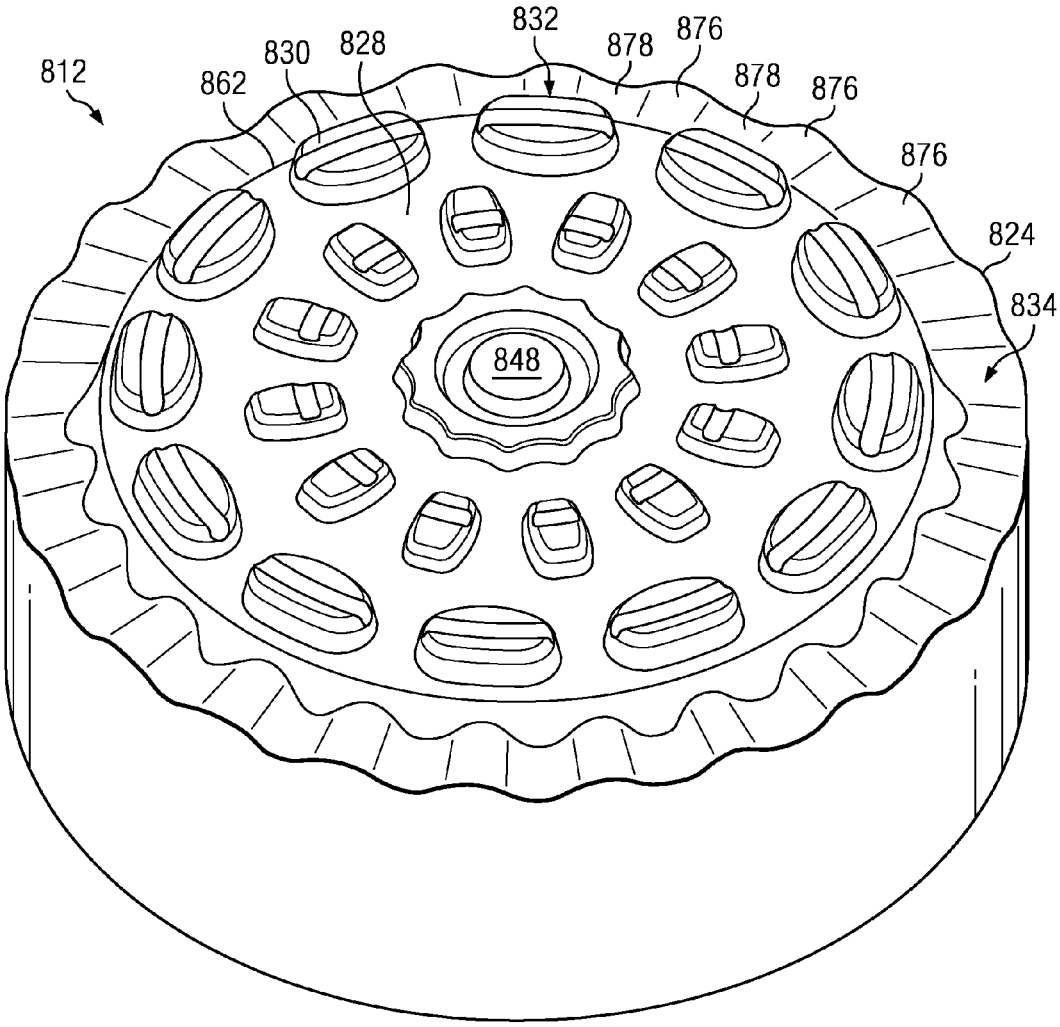
FIG. 15 is a perspective view of a substrate according to an exemplary embodiment of the invention.

Another exemplary embodiment of a substrate and interface surface is shown in FIG. 15. In this embodiment, the outer band 834 between the outer edge 824 and the first row 832 of projections 830 has a wave-like or curved pattern, i.e., a non-planar pattern, with alternating hills 876 and valleys 878. In an exemplary embodiment, these hills and valleys are radially tapered, such that they are wider at the radially outward edge of the band 834, and more narrow at the radially inward edge. The three-dimensional wave pattern disrupts stress fields forming in the ultra-hard material layer above this outer band 834 and interrupts the propagation of cracks circumferentially along such outer band. The alternating hills and valleys create corresponding alternating pockets of tensile and compressive stresses. Cracks growing in a region of tensile stress will slow or stop when they reach an adjacent region of compressive stress, and vice versa.

The wave is formed in the outer band 834 radially outside of the projections 830. The projections 830 have a height that is higher (greater) than the hills 876 in the wave. Additionally, the projections are located in an inner section 828 that is raised above the band 834. A step 862, which may be curved, connects the outer band 834 and the inner section 828.

Figure 16:
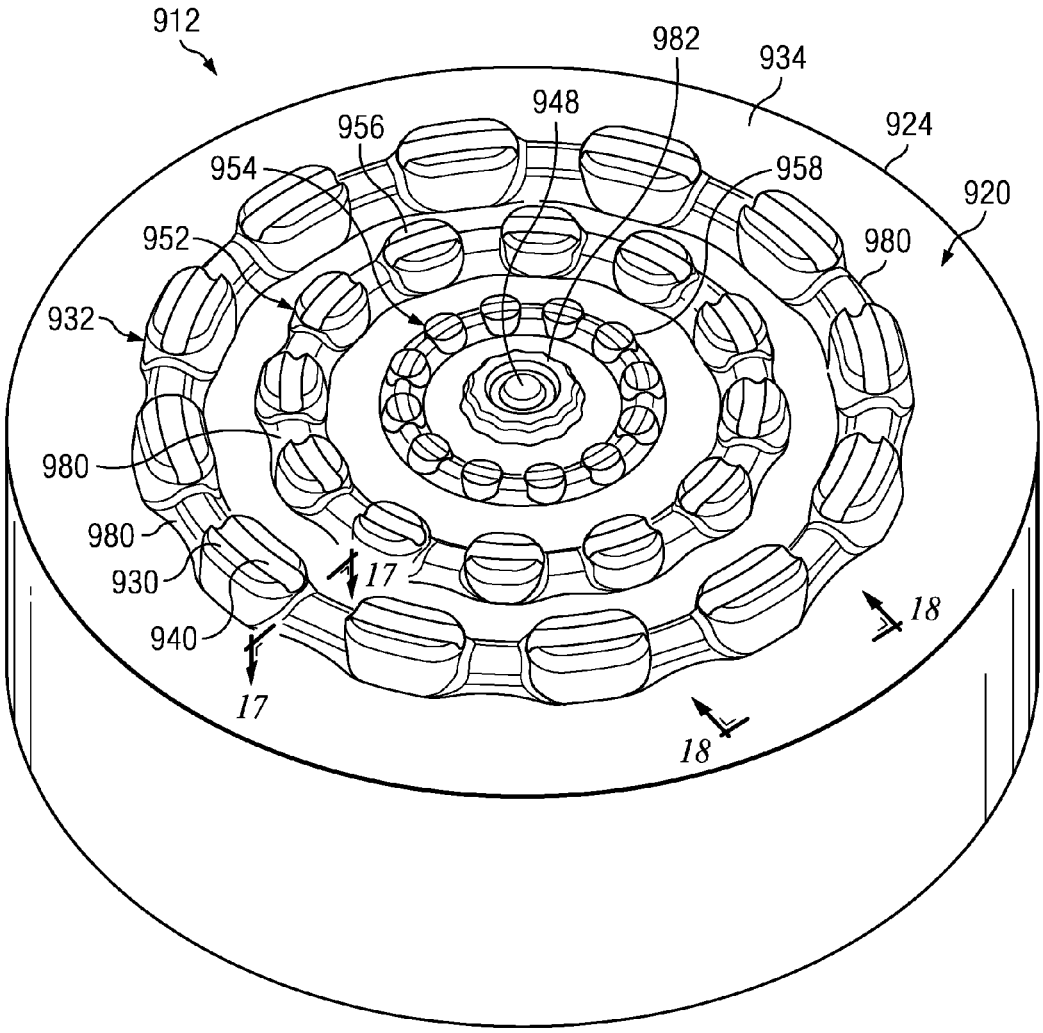
FIG. 16 is a perspective view of a substrate according to an exemplary embodiment of the invention.
Figure 17:
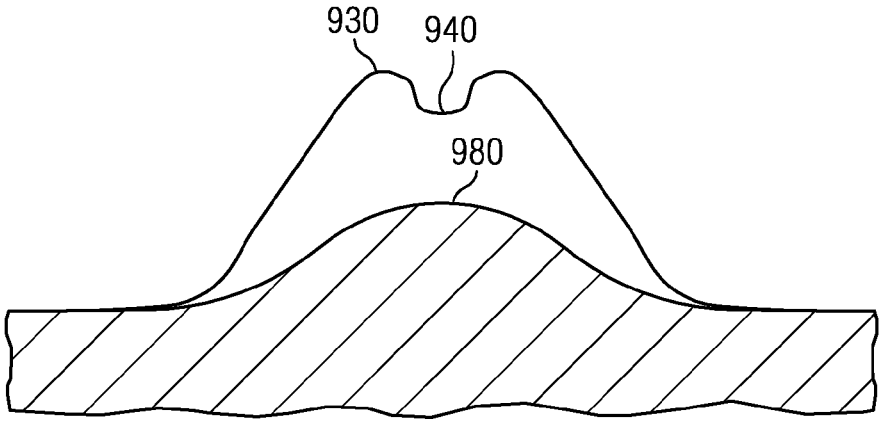
FIG. 17 is a cross-sectional view of a projection on the substrate of FIG. 16, taken along the line 17-17 in FIG. 16.

Another embodiment of a substrate and interface surface is shown in FIG. 16. In this embodiment, the projections 930 in the first or outer annular row 932 are connected by a saddle or bridge 980. FIG. 17 shows a cross-sectional view of the projection 930 and bridge 980, as indicated in FIG. 16. As shown in FIG. 17, the bridge 980 has a convex shape in a radial direction. That is, moving outwardly along the radius of the interface surface 920, the bridge 980 curves smoothly upwardly and then downwardly to form a convex bulge. Each projection 930 extends higher (greater) than does the bridge 980, but both extend above the outer band 934. The height of the bridge is, in an exemplary embodiment, approximately 25-75% of the height of the projection, and in another embodiment, approximately 35-40% of the height of the projection.

Figure 18:
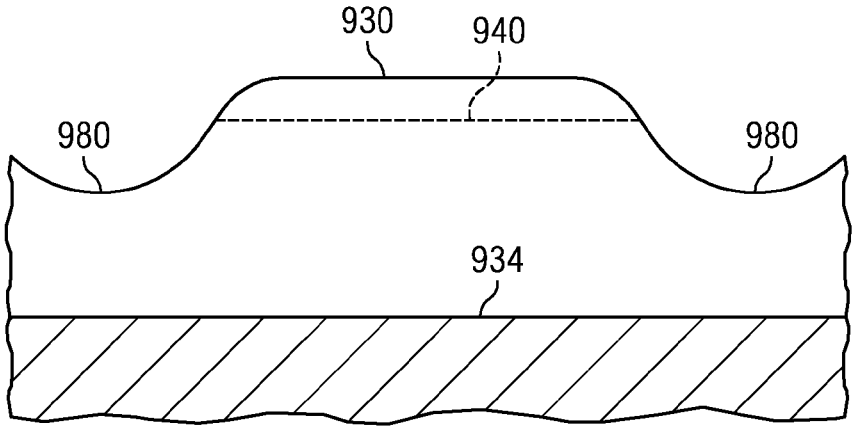
FIG. 18 is a side view of a projection on the substrate of FIG. 16, taken along the line 18-18 in FIG. 16.

FIG. 18 shows a side view of the projection 930 and bridge 980, as indicated in FIG. 16. As shown in FIG. 18, the bridge 980 has a concave shape in the circumferential direction. That is, moving along the circumference at the location of the bridge, the bridge 980 curves smoothly downwardly away from the projection and then back upwardly toward the next projection, forming a concave depression. In the shown exemplary embodiment, the bridge 980 does not extend all the way down to a lowest point of an outer band 934. The circumferential groove 940 in the projection 930 is shown in dotted lines in FIG. 18. Thus, in an exemplary embodiment, the bridge 980 has a saddle-shape, having a concave curve in the circumferential direction and having a convex curve in the radial direction.

Figure 19:
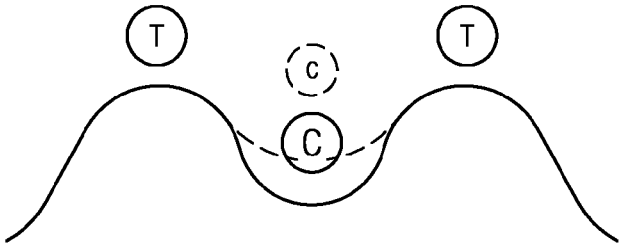
FIG. 19 is a diagram of a stress field above and between projections on the substrate of FIG. 16.

The bridge 980 reduces stresses between the projections 930, reducing the difference in magnitude between the adjacent compressive and tensile stress fields. That is, as shown in FIG. 19, the difference between the stresses in the adjacent compressive and tensile areas with the bridge is less than it would be without the bridge. As shown in dotted lines, the bridge reduces the magnitude of the compressive stress between adjacent projections. The area of compressive stress above the bridge is beneficial because it interrupts the tensile stresses forming above each projection. For example, a simple annular ring creates an uninterrupted annular path of tensile stress. The areas of compressive stress between the spaced-apart projections 930 interrupt that tensile stress field. However, if the compressive stress is too large, it creates a large magnitude difference between the compressive stress and the adjacent areas of tensile stress, which can create large residual stresses at the interface when the substrate and ultra-hard layer are subjected to very high pressures during HPHT sintering. Therefore, the bridge 980 both interrupts the areas of tensile stress above adjacent projections and reduces the magnitude of the compressive stresses providing that interruption.

An interface surface with these saddle-shaped bridges is particularly suited for high pressure/high-density diamond in the ultra-hard material layer. Stresses can be more pronounced in ultra-hard material layers that have a high diamond volume content, because this material has a low thermal expansion, and the difference in expansion between the ultra-hard layer and the substrate is higher in magnitude, as compared to lower-diamond-density layers. Accordingly, the residual stresses in these layers can be higher, and thus the bridge 980 is provided to balance the stresses and provide smoother transitions between stress regions. Initial testing of high diamond volume fraction cutting elements having the interface surface shown in FIG. 16 shows reduced crack propagation as compared to prior art interfaces. In one embodiment, the sintered ultra-hard material is polycrystalline diamond having a density below approximately 3.93 g/cc (grams per cubic centimeter) and a nominal grain size of approximately 13 microns or less. In another embodiment, the ultra-hard material has a diamond volume percentage of about 93% or more.

Referring again to FIG. 16, the projections 930 are shown with circumferentially-extending grooves 940. These grooves are optional, and in other embodiments, a substrate with bridges such as bridges 980 does not include the grooves 940. Alternatively, the grooves may extend radially rather than circumferentially.

The interface surface 920 includes a second or intermediate annular row 952 of spaced-apart projections 956, located radially inside the first row 932, and a third or inner annular row 954 of projections 958 located radially inside the second row 952. The projections in the second and third rows may also be connected by bridges 980, as in the first row 932. The bridges in these rows also take on a saddle-shape, extending concave circumferentially and convex radially. The bridges in these inner rows are optional.

A central projection 948 may be located radially inside the third row 954, and it may include an outer rim 982 with a wavy outer surface. As discussed previously, the central projection 948 interrupts the stresses inside the inner row of projections.

The bridge described above with respect to FIG. 16 may be used with any of the previously described embodiments. Moreover, the non-planar outer surface or band 834 described with respect to FIG. 15 may be used with any of the previously described embodiments. Additionally, the features described above in different exemplary embodiments may be mixed and matched, combining different features of different embodiments. For example, the first row of projections may have radial grooves as shown in FIG. 9, and the second row of projections may have circumferential grooves as shown in FIG. 11, or vice versa.

Although the present invention has been described and illustrated in respect to exemplary embodiments, it is to be understood that it is not to be so limited, since changes and modifications may be made therein which are within the full intended scope of the this invention. For example, the substrate described herein has been identified by way of example. It should be understood that the ultra-hard material may be attached to other carbide substrates besides tungsten carbide substrates, such as substrates made of carbides of W, Ti, Mo, Nb, V, Hf, Ta, and Cr.

What is claimed:

1. A cutting element having a longitudinal axis extending towards a direction, the cutting element comprising:

a substrate comprising a periphery and an interface surface having a radial direction and a circumferential direction; and an ultra hard material layer formed over the substrate and having an interface surface having a radial direction and a circumferential direction, wherein one of the interface surface of the substrate and the interface surface of the ultra hard material layer comprises:

a first annular section comprising an outer band and extending along the direction to a first level;

a second section located radially inwardly of the first annular section and extending along the direction to a second level;

a plurality of spaced-apart projections arranged in an annular row and at least a portion of each of the plurality of spaced-apart projections is located radially inward of the outer band and extending along the direction beyond said first and second levels; and a circumferential groove bisecting an upper surface of each projection, wherein each circumferential groove has a depth extending to a level that is spaced apart along the direction from said first and said second levels.

2. The cutting element of claim 1, wherein the one interface surface is the interface surface of the substrate.

3. The cutting element of claim 2, wherein the groove has a lengthwise curvature.

4. The cutting element of claim 3, wherein the center of lengthwise curvature of the groove is substantially the same as the center of curvature of a circumference of the substrate at the radial position of the groove.

5. The cutting element of claim 2, wherein the groove has a depth that is at least approximately 50% of a width of the groove.

6. The cutting element of claim 2, wherein the groove has a depth that is less than a height of the projection.

7. The cutting element of claim 2, further comprising a central projection radially inside the annular row of projections.

8. The cutting element of claim 2, further comprising a second plurality of spaced-apart projections arranged in a second annular row and located on the interface surface radially inside the first annular row.

9. The cutting element of claim 8, wherein each of the projections of the second annular row comprises a groove on its upper surface.

10. The cutting element of claim 9, wherein the grooves in the projections of the first and second rows extend in the circumferential direction.

11. The cutting element of claim 9, wherein the grooves in the projections of the second row extend in the radial direction.

12. The cutting element of claim 8, wherein the first and second rows comprise the same number of spaced-apart projections.

13. The cutting element of claim 12, wherein the projections in the first and second rows are staggered relative to each other.

14. The cutting element of claim 8, wherein the projections of the second row extend to a lesser height than the projections of the first row but have substantially the same proportionate dimensions.

15. The cutting element of claim 2, further comprising at least one bridge coupling adjacent projections.

16. The cutting element of claim 15, wherein the at least one bridge comprises a saddle shape having a surface that has a convex curve in a radial direction and a concave curve in a circumferential direction.

17. The cutting element of claim 15, wherein the ultra-hard material comprises polycrystalline diamond having a grain size of at most approximately 13 microns.

18. The cutting element of claim 15, wherein the ultra-hard material comprises polycrystalline diamond having a diamond volume of 93 percent or more.

19. The cutting element of claim 15, wherein the bridge has a height that is approximately 35-40% of the height of the projections.

20. The cutting element of claim 1, wherein each of the plurality of spaced apart projections are located wholly within the second section.

21. An earth boring drill bit comprising a body having the cutting element of claim 1 mounted thereon.

22. The cutting element of claim 1, wherein each projection is generally trapezoidal, oval or triangular in plan view having rounded corners.

23. The cutting element as recited in claim 1, wherein the outer band is a non-planar outer band comprising repeating hills and valleys.

24. The cutting element of claim 23, wherein the repeated hills and valleys do not extend beyond said outer band.

25. The cutting element of claim 1, wherein the plurality of spaced-apart projections straddle the first annular and second sections.

26. The cutting element of claim 1, wherein the first and second levels are the same level.

27. The cutting element of claim 1, wherein the first level is spaced apart from the second level.

28. The cutting element of claim 1, wherein each circumferential groove extends along an entire circumferential length of its corresponding projection.

29. The cutting element of claim 1, wherein the outer band is a non-planar outer band.

30. A cutting element having a longitudinal axis extending towards a direction, the cutting element comprising:

a substrate comprising a periphery and an interface surface having a radial direction and a circumferential direction; and an ultra hard material layer formed over the substrate and having an interface surface having a radial direction and a circumferential direction, wherein one of the interface surface of the substrate and the interface surface of the ultra hard material layer comprises:

a first annular section comprising an outer band and extending along the direction to a first level;

a second section located radially inwardly of the first annular section and extending along the direction to a second level spaced from the first level along the direction;

a plurality of spaced-apart projections arranged in an annular row and at least a portion of each of the plurality of spaced-apart projections are located radially inward of the outer band; and a bridge coupling adjacent projections, said bridge having a saddle shape comprising a surface that has a convex curve in a radial direction and a concave curve in a circumferential direction.

31. The cutting element of claim 30, wherein the plurality of spaced-apart projections straddle the first annular and second sections.

32. A cutting element having a longitudinal axis extending towards a direction, the cutting element comprising:

a substrate comprising a periphery and an interface surface having a radial direction and a circumferential direction; and an ultra hard material layer formed over the substrate and having an interface surface having a radial direction and a circumferential direction, wherein one of the interface surface of the substrate and the interface surface of the ultra hard material layer comprises:

a first annular section extending along the direction to a first level and comprising an outer band;

a second section extending along the direction to a second level and located radially inwardly of the first annular section defining a step between said first annular section and said second section extending from said first level to said second level;

a plurality of spaced-apart projections arranged in an annular row and at least a portion of each of the plurality of spaced-apart projections is located radially inward of the outer band; and a groove bisecting an upper surface of each projection and having a depth not extending to said first and second levels, said projections being spaced apart by valleys extending at least to one of said interface surface first and second levels.

33. The cutting element of claim 32, wherein the one interface surface is the interface surface of the substrate.

34. The cutting element of claim 33, wherein the groove extends in the circumferential direction.

35. The cutting element of claim 33, wherein the groove extends in the radial direction.

36. The cutting element of claim 33, wherein the groove has a lengthwise curvature.

37. The cutting element of claim 36, wherein the center of lengthwise curvature of the groove is substantially the same as the center of curvature of a circumference of the substrate at the radial position of the groove.

38. The cutting element of claim 33, wherein the groove is linear.

39. The cutting element of claim 33, wherein the groove depth tapers.

40. The cutting element of claim 33, wherein the groove has a depth that is at least approximately 50% of a width of the groove.

41. The cutting element of claim 33, wherein the groove has a depth that is less than a height of the projection.

42. The cutting element of claim 33, further comprising a central projection radially inside the annular row of projections.

43. The cutting element of claim 33, further comprising a second plurality of spaced-apart projections arranged in a second annular row and located on the interface surface radially inside the first annular row.

44. The cutting element of claim 43, wherein each of the projections of the second annular row comprises a groove on its upper surface.

45. The cutting element of claim 44, wherein the grooves in the projections of the first and second rows extend in the circumferential direction.

46. The cutting element of claim 44, wherein the grooves in the projections of the first and second rows extend in the radial direction.

47. The cutting element of claim 44, wherein the grooves in the projections of the first row extend in one of the circumferential or the radial direction, and the grooves in the projections of the second row extend in the other of the circumferential or the radial direction.

48. The cutting element of claim 43, wherein the first and second rows comprise the same number of spaced-apart projections.

49. The cutting element of claim 48, wherein the projections in the first and second rows are staggered relative to each other.

50. The cutting element of claim 43, wherein the projections of the second row extend to a lesser height than the projections of the first row but have substantially the same proportionate dimensions.

51. The cutting element of claim 32, wherein each of the plurality of spaced apart projections are located wholly within the second section.

52. The cutting element of claim 32, wherein the outer band comprises a wave pattern comprising repeating hills and valleys.

53. The cutting element of claim 32, wherein each projection is generally trapezoidal, oval or triangular in plan view having rounded corners.

54. The cutting element as recited in claim 32 wherein the outer band is a non-planar outer band comprising repeating hills and valleys.

55. The cutting element of claim 54, wherein the repeated hills and valleys do not extend beyond said outer band.

56. An earth boring drill bit comprising a body having the cutting element of claim 32 mounted thereon.

57. A cutting element comprising:

a substrate comprising a periphery and an interface surface having a radial direction and a circumferential direction; and an ultra hard material layer formed over the substrate and having an interface surface having a radial direction and a circumferential direction, wherein one of the interface surface of the substrate or the interface surface and the ultra hard material layer comprises:

a first annular section comprising an outer band;

a second section located radially inwardly of the first annular section;

a plurality of spaced-apart projections arranged in an annular row and at least a portion of each of the plurality of spaced-apart projections is located radially inward of the outer band; and at least one bridge coupling adjacent projections, said at least one bridge comprising a saddle shape having a surface that has a convex curve in a radial direction and a concave curve in a circumferential direction.

58. The cutting element of claim 57, further comprising a groove bisecting an upper surface of each projection.

59. The cutting element of claim 58, wherein the ultra-hard material comprises polycrystalline diamond having a grain size of at most approximately 13 microns.

60. The cutting element of claim 58, wherein the ultra-hard material comprises polycrystalline diamond having a diamond volume of 93 percent or more.

61. The cutting element of claim 58, wherein the bridge has a height that is approximately 35-40% of the height of the projections.

62. An earth boring drill bit comprising a body having the cutting element of claim 57 mounted thereon.

63. The cutting element of claim 57, wherein the outer band is a non-planar outer band.

* * * * *